United States Patent [19]

Sech

[11] Patent Number: 4,753,743

[45] Date of Patent: Jun. 28, 1988

[54] HOT MELT METALWORKING LUBRICANT

[75] Inventor: John M. Sech, Whiting, Ind.

[73] Assignee: Nalco Chemical Company, Naperville, Ill.

[21] Appl. No.: 7,874

[22] Filed: Jan. 28, 1987

[51] Int. Cl.[4] ..... C10M 135/10; C10M 129/74

[52] U.S. Cl. ..... 252/33.4; 252/56 S; 252/51.5 A; 72/42

[58] Field of Search ..... 252/56 S, 33.4, 51.5 A; 72/42

[56] References Cited

U.S. PATENT DOCUMENTS

| | | | |
|---|---|---|---|
| 4,116,872 | 9/1978 | Jahnke | 252/56 S |
| 4,191,658 | 3/1980 | Jahnke | 252/32.7 |
| 4,256,594 | 3/1981 | Rysek | 252/56 S |
| 4,321,308 | 3/1982 | Jahnke | 428/469 |
| 4,346,148 | 8/1982 | Jahnke | 252/56 S |

*Primary Examiner*—Jacqueline V. Howard

*Attorney, Agent, or Firm*—John G. Premo; Joan I. Norek; Anthony L. Cupoli

[57] ABSTRACT

Metalworking applications are provided with a lubricant comprised of at least one substantially saturated ester formed of a polyhydric alcohol and at least one carboxylic acid, from 5 to 15 weight percent of a partially-esterified vegetable oil, an air-oxidized vegetable oil, a high molecular weight alkali metal sulfonate salt, a high carbon amide, a high molecular weight ethoxylated organic alcohol, or mixtures thereof and from 0.5 to 3.0 weight percent of an ethylene homopolymer, a polymer derived from ethylene and ethylenically unsaturated carboxylic acid monomers, oxidized derivatives of ethylene polymers, or mixtures thereof. The lubricant is applied to metal in molten form.

34 Claims, No Drawings

HOT MELT METALWORKING LUBRICANT

TECHNICAL FIELD OF THE INVENTION

The present invention is in the technical field of metalworking operations and lubricants used therein, particularly prelubes for steel in automotive applications.

BACKGROUND OF THE INVENTION

Lubricants are generally employed in metalworking operations. Such operations include rolling, forging, blanking, bending, stamping, drawing, cutting, punching, spinning, extruding, coining, hobbing, swaging, and the like. The present invention concerns lubricants for such type of metalworking operations, and in particular such operations as employed in automotive applications. In the automotive field, the term "stamping" is used as a broad term to cover all pressworking operations on sheet metal, which operations may be further categorized as cutting, drawing, or coining. Automotive stamped parts may be produced by one or a combination of these three fundamental operations.

Metalworking lubricants facilitate these operations generally by reducing friction between the metal being worked and the element employed for that process, and thus reducing the power required for a given operation, reducing the wear of the surfaces of the work elements that operate on the metals, and preventing sticking between the metal being worked and the work elements operating thereon or between metal pieces during storage, handling or operations, and in addition often provide corrosion protection to the metal being processed. In automotive applications prevention of sticking between metal pieces and between such pieces and the work elements is of extreme importance.

In some metalworking processes, including automotive applications, coils or rolls of steel, in particular cold rolled or galvanized steel sheets, are cut into pieces, called blanks, which are stamped or drawn to produce the desired parts. Such parts formed by stamping or drawing, as these terms are generally used, include fenders, hoods, deck lids, quarter panels, oil pans, fuel tanks, floor panels, inner and outer door panels, and the like. Prior to the use of lubricants known as prelubes, the normal procedure was to apply an oil at the steel mill to such coils or rolls as a rust preventative prior to shipping to the processing site, such as a stamping plant. Between the steps of cutting the sheets into blanks and stamping or drawing, such rust preventive oil would then be removed by washing and a drawing lubricant applied to the metal and at times the work element immediately before stamping or drawing. Such drawing lubricant is used to reduce friction and facilitate the metalworking operation.

In recent times the use of separate rust preventive oils and drawing lubricants has been in some instances replaced by the use of a single composition known as a prelube. Prelubes are generally applied at the steel mill during temper rolling or inspection, as would be a rust preventive oil, prior to shipping and are not intentionally removed from the metal until after the blanks are formed and the parts formed. Thus the use of such prelubes eliminates the steps of removing the oil and applying a drawing lubricant before further working.

Prelubes thus must function as both a rust preventative and drawing lubricant. In many instances, and particularly for automotive applications, a prelube must be removable with alkaline cleaners, non-staining to the metal, and compatible with other chemicals utilized in producing the products in question.

In more detail, the advantages obtained by the efficiency of using a prelube would be diminished or nullified if unusual methods were necessary to remove the lubricant from the final product. In the automotive field, alkaline cleaners are the normal compositions employed for cleaning. Some substances with lubricating properties, for instance wax films, cannot be easily removed with alkaline cleaners and thus their use entails a serious detrimental effect on the efficiency of overall operations.

As to metal staining, there are at times instances where steel coils are stored for long periods before use. Some substances may oxidize to an extent during storage and the oxidation products adversely effect the metal, for instance by the oxidation of oils to fatty acids which stain steel sheets, particularly mild steel sheets. Hence industries in which storage periods are a potential require prelubes or other substances in contact with the metal during storage that are substantially nonstaining.

As to compatibility with other chemicals, parts are sometimes formed with severe bends which may entrap some of the lubricant used in the metalworking operation. Thus although the lubricant may be removed after working from all exposed surfaces, the entrapped portion remains and may be vaporized or otherwise released under subsequent processing conditions. The potential for releasing of entrapped lubricant thus requires compatibility between the lubricant and cathodic primers and automotive adhesives. The cathodic primers are used in electrostatic coating operations. Adhesives are used to bond parts where welding or other methods are unsuitable. Although some parts being formed in a typical stamping plant will not be painted nor come into contact with adhesives, and thus the use of noncompatible lubricants thereon would pose minimal risks, efficiency in the overall operations makes it highly desirable to utilize the same lubricant or prelube throughout the plant.

The prelubes now used commercially in the automotive industry are hydrocarbon based compositions containing sulfurized or waxy components, liquid at ambient room temperature. These compositions tend to drain off the metal surfaces, creating maintenance problems, and further tend to be or become unevenly distributed on the metal surfaces due to capillary forces. The properties of rust prevention and drawing assistance both depend in significant part on uniformity of lubricant film. Such tendency to puddle on the metal surface diminishes a lubricant's potential in providing protection from rust and in facilitating the stamping or drawing operations. Thus at least the automotive industry desires a prelube that provides lubricant film uniformity and film strength undiminished during shipping and storage periods. Further, film strength is a particularly significant property for facilitating drawing operations; a lubricant having high film strength will permit more severe draws to be made.

A lubricant that is effective for each of the purposes for which it is employed at use levels less than those otherwise encountered is desirable, contributing to the cost efficiency of any given operation.

It is an object of the present invention to provide a metalworking lubricant, and more particularly a lubricant that may be used as a prelube, that provides the foregoing desirable characteristics and permits the attainment of the foregoing advantages in the metalworking field, and in particular in the automotive industry. It is a further object of the present invention to provide a method of lubricating metal, particularly colled rolled and galvanized steel sheets, particularly prior to stamping and drawing operations, that provides the foregoing desired advantages. These and other objects of the invention are described below.

DISCLOSURE OF THE INVENTION

The present invention provides a lubricant for metalworking operations comprising at least one substantially saturated ester formed of a polyhydric alcohol and at least one carboxylic acid, from 5 to 15 weight percent of a partially-esterified vegetable oil, an air-oxidized vegetable oil, a high molecular weight alkali metal sulfonate salt, a high carbon amide, a high molecular weight ethoxylated organic alcohol, or mixtures thereof, and from 0.5 to 3.0 weight percent of an ethylene homopolymer, a polymer derived from ethylene and ethylenically unsaturated carboxylic acid monomers, oxidized derivatives of ethylene polymers, or mixtures thereof. The lubricant may further include from 0.5 to 3.0 weight percent of an antioxidant, particularly a hindered phenol type antioxidant.

The present invention also provides a method of lubricating metal comprising applying to metal a coating of the lubricant according to the present invention in molten form. Preferably the lubricant is applied to the metal and then the metal is worked without removal of the lubricant.

In preferred embodiments the substantially saturated ester is formed of an aliphatic polyhydric alcohol having from 2 to 10 carbon atoms and aliphatic monocarboxylic acids having from 2 to 26 carbon atoms. The aliphatic monocarboxylic acids preferably have substantially unbranched carbon chains. The ester preferably has a melting point of from 30° to 100° C.

In more preferred embodiments the substantially saturated ester is a diglyceride or triglyceride formed with carboxylic acids at least 90 percent of which have carbon chains containing from 14 to 22 carbon atoms. A very preferred embodiment is a triglyceride, the substantially hydrogenated triglyceride derived from tallow.

In further preferred embodiments the partially-esterified vegetable oil and/or air-oxidized vegetable oil are derived from castor oil, soybean oil, rape seed oil, cotton seed oil, or mixtures thereof. The high molecular weight alkali metal sulfonate is one having a molecular weight of from 400 to 1,000. The high carbon amide is one having a carbon chain comprised of from 10 to 22 carbon atoms, and a very preferred embodiment is oleyl amide.

The high molecular weight ethoxylated organic alcohol preferably is formed of a 10 to 20 carbon alcohol and from 2 to 8 ethylene oxide moles per mole of alcohol. More preferably the alcohol is a 14 to 16 carbon primary alcohol reacted with about 4 ethylene oxide moles per mole of alcohol.

In preferred embodiments the ethylene homopolymer, polymer derived from ethylene and ethylenically unsaturated carboxylic acid monomers, oxidized derivatives thereof, or mixtures thereof, is a composition having a melting point of from 85° to 115° C., a composition having a hardness of from 9 to 22 dmm at 25° C., a composition having an acid number of from 70 to 140, particularly a copolymer of ethylene and acrylic acid having a hardness of from 12 to 16 and an acid number of from 110 to 130.

The lubricant preferably has from 80 to 95 weight percent of at least one substantially saturated ester formed of an aliphatic polyhydric alcohol having from 20 to 10 carbon atoms and aliphatic monocarboxylic acids having from 2 to 26 carbons atoms.

These and other preferred embodiments are described in more detail below.

PREFERRED EMBODIMENTS OF THE INVENTION

The lubricant according to the present invention may be considered a "hot melt" type of coating particularly useful in metalworking operations and particularly advantageous in metalworking operations as a prelube for automotive metalworking applications. The automotive industry employs many stamped parts, i.e., parts produced by one or a combination of various pressworking operations, which may be subcategorized as cutting, drawing, and coining operations. Lubricants are employed during these and other metalworking operations to reduce the power required, the surface wear on the work elements, and the possibility of the metal pieces adhering to the work elements or each other. In addition it is desirable that such lubricant also provide corrosion protection to the metal on which it is coated. In some metalworking applications, for instance automotive stamping operations, it is highly desirable to use a lubricant that can be applied to the coils or rolls of steel sheets before shipping to the stamping plant, for instance during the temper rolling or inspection, whereby corrosion protection during shipping, handling, or storage is accomplished, and which also performs as a metalworking lubricant during subsequent operations, whereby the steps of removing one coating and applying another are eliminated. As mentioned above, such lubricants are called prelubes and must function as both rust preventatives and drawing lubricants. The lubricant according to the present invention, as described in more detail below, is generally one that is solid at ambient room temperature and is applied to the metal in molten form, i.e., at a suitable elevated temperature at which the lubricant is melted and thus liquified for ease of application and to provide a uniform coating. In contrast to lubricants that, while otherwise having suitable rust preventative and drawing lubricant properties, are liquid at ambient room temperatures, the lubricant of the present invention will generally resolidify upon cooling from its application temperature and the uniformity of the coating will be retained throughout subsequent handling and processing steps. As mentioned above, the properties of rust prevention and drawing assistance are both dependent in significant part on the uniformity of lubricant film and these goals are greatly advanced by a lubricant with which one can achieve a uniform coating in the first instance which uniformity is substantially retained until it is desired to remove the coating, such as the lubricant of the present invention.

The lubricant according to the present invention contains at least one substantially saturated ester formed of a polyhydric alcohol and at least one carboxylic acid. Such esters generally comprise a major portion of the lubricant and are believed to provide both lubricity and film-forming properties to the lubricant, and in preferred embodiment have melting points of from 30° C. to 100° C. (86° F. to 212° F.). Generally the selection of such esters and other lubricant components will provide a lubricant that is substantially solidified at ambient room temperature and yet is easily coated onto metal at reasonable elevated temperatures to provide a uniform coating.

The polyhdric alcohol portion of such esters preferably are aliphatic alcohols such as ethylene glycol, glycerol, pentaerythritol, and the like, preferably being polyhydric alcohols having from 2 to 10 carbon atoms. The carboxylic acids forming the esters perferably are aliphatic monocarboxylic acids, and more preferably are such acids comprised of from 2 to 26 carbon atoms. The esters may be formed of carboxylic acid moieties of various carbon atom chain lengths and mixtures of branched and unbranched carbon chains, but perferably the unbranched carbon chain moieties will predominate.

In preferred embodiment the esters are substantially saturated diglycerides and triglycerides formed with carboxylic acids at least 90 percent of which have carbon chains containing from 14 to 22 carbon atoms. A particularly useful ester is one formed substantially of the trihydric glycerol and carboxylic acids at least 90 percent of which have carbon chains of 16 to 18 carbons atoms, such as the substantially hydrogenated triglyceride derived from tallow, having a melting point of about 52° C. (126° F.) and wherein about 30 percent of the carboxylate chains are those having 16 carbon atoms and about 65 percent of the carboxylate chains are those having 18 carbon atoms, the remainder being chains of 14 carbon atoms (2%), 15 carbon atoms (0.5%), and 17 carbon atoms (2.5%).

It has been found that such substantially saturated esters do not alone provide sufficient film flexibility to the lubricant coating for metalworking applications and handling attendant thereupon. The lubricant according to the present invention further contains from 5 to 15 percent of certain compositions, all somewhat polar, of high viscosity at the elevated temperatures required to render the lubricant molten, and compatible with the substantially saturated esters. As mentioned above, these compositions are partially-esterified vegetable oils, air-oxidized vegetable oils, high molecular weight alkali metal sulfonate salts, high carbon amides, and high molecular weight ethoxylated alcohols. Suitable vegetable oils from which such partial esters and air-oxidized derivatives can be derived include castor oil, soybean oil, rape seed oil, cotton seed oil, and the like. Preferably the partial esters are formed with organic diacids having molecular weights of from about 250 to 500. A particularly useful composition is a partially-esterified castor oil derivative having an acid number of about 45 to 60, and preferably of about 50, formed by the partial esterification of castor oil with organic diacid of about 340–360 molecular weight, by methods well known to those of ordinary skill in the art. Also found to be particularly useful are the air-oxidized derivative of soybean oil. Air oxidation of vegetable oils provides a composition of higher molecular weight by mechanisms familiar to those of ordinary skill in the art. The high molecular weight alkali metal sulfonate salts preferably are those having a molecular weight from 400 to 1,000, and more preferably from about 500 to about 800. A particularly useful high molecular weight alkali metal sulfonate salt is a sodium sulfonate having a molecular weight of 560 to 640. The high carbon amides are organic compounds having amide functionality, preferably those having carbon chains of from 10 to 22 carbon atoms, and may be saturated or unsaturated, such as decyl amide, undecyl amide, tridecyl amide, tetradecyl amide and the like, and oleic amide, linoleic amide, linolenic amide, and the like. A particularly useful high carbon amide is 18 carbon unsaturated oleyl amide. The high molecular weight ethoxylated alcohols are preferably those formed with alcohols having 10 to 20 carbon atoms, reacted with from 2 to 8 moles of ethylene oxide by methods well known to those of ordinary skill in the art. Particularly useful high molecular weight ethoxylated alcohols are those derived from primary alcohols of from 14 to 16 carbon atoms and about 4 moles of ethylene oxide per mole of alcohol. The above compositions are believed to act as plasticizers for the substantially unsaturated esters, providing the necessary degree of film flexibility to the lubricant for metalworking applications and handling. Further these compositions when blended with the esters in the lubricant of the present invention have been found compatible and create no effect in combination deletorious to the functional properties of the lubricant.

The lubricant according to the present invention also contains from 0.5 to 3.0 weight percent of a polymeric composition comprised of an ethylene homopolymer, a polymer derived from the polymerization of ethylene and ethylenically unsaturated carboxylic monomers, oxidized derivatives of such ethylene polymers, and mixtures thereof. Such polymeric compositions preferably have molecular weights in excess of 2,000 and melting points of from 85° to 115° C. (185° to 239° F.). These polymers have been found to provide to the lubricant film strength and lubricity and thus, together with the substantially saturated esters and the certain plasticizing compositions described above, result in a lubricant that has superior film strength and lubricity for metalworking applications. In preferred embodiments such polymer has a hardness of from 9 to 22 dmm (at 25° C.) and an acid number of from 70 to 140 (mg KOH/g). A particularly preferred polymer is an ethylene based polymer comprised of units derived from ethylene and acrylic acid, with a melting point of from 90° to 110°. A particularly useful ethylene/acrylic acid copolymer is one having a hardness of from about 12 to 16 and an acid number of from about 110 to 130.

The lubricant according to the present invention provides a uniform film that is retained during handling and working to a degree not achievable with an oil-based lubricant. Due to the uniformity and strength of the film coating provided by the lubricant, more severe draws can be made in metal working. Most draws can be made using a coating thickness (weight of lubricant per unit area basis) that is one-third of that required for conventional metalworking lubricants; thus a great materials savings is achieved with the lubricant of the present invention. Further, as demonstrated below, the lubricant is easily removable with a standard automotive alkaline cleaner and thus is compatible with conventional processing methods used in the automotive industry. It has been found compatible with conventional processing methods used in the automotive industry. It has been found compatible with electrocoated paint primers and with adhesives commercially used in the automotive industry. In addition, the lubricant of the present invention has been found to provide rust protection to metals that far exceeds any hydrocarbon rust preventative.

The lubricant according to the present invention may include from 0.5 to 3.0 weight percent of an antioxidant, such as a hindered phenol antioxidant which has been found compatible with the components of the lubricant. Such an antioxidant additive may be considered when the potential for lubricant staining of mild metal is of serious concern, as an additional protection measure. The lubricant of the present invention might further include other additives but in preferred embodiment is limited to the components described above.

In preferred embodiment, the lubricant is comprised of 80 to 95 weight percent of at least one substantially saturated ester formed of an aliphatic polyhydric alcohol having from 2 to 10 carbon atoms and aliphatic monocarboxylic acid having from 2 to 26 carbon atoms, from 5 to 15 weight percent of the plasticizing compositions described above. In further preferred embodiment such lubricant may further contain 0.5 to 3.0 weight percent of an antioxidant.

The lubricant of the present invention is particularly useful as a prelube, particularly a prelube for automotive applications. Its properties, however, may make it an excellent selection as a lubricant outside of such application, and within such applications may also be applied to work elements, such as dies and the like.

The lubricant according to the present invention may advantageously be coated onto metal by passing the metal through a molten bath, removing the excess by a squeegy or other methods. It may be brushed on or applied in any manner suitable for a viscous liquid, provided that the lubricant is kept in molten state during application. For coating by brushing or similar method where conditions are such that the molten lubricant will cool off somewhat during application, for instance when brushing the lubricant on to single panels in ambient room temperature environment, the panels themselves may also be heated to avoid solidification of the lubricant or portions thereof before the coating is completed.

The advantages and utility of the lubricant according to the present invention are further described in the following examples.

EXAMPLE 1

A lubricant according to the present invention was prepared as follows. In a blending vessel, equipped with both stirring and heating means, 88.1 parts by weight of a hydrogenated triglyceride derived from tallow, commercially available under the registered trademark of NEUSTRENE 059 from Humko Chemical Division of Witco Chemical Corporation, was admixed with 1.0 parts by weight of a hindered phenol type antioxidant, commercially available under the tradename IONOL from Shell Oil Company, and 1.0 parts by weight of an ethylene copolymer with acrylic acid commercially available under the registered trademark of A-C 5120 Copolymer from Allied Corporation, and the blend heated to 220° F., at which temperature all components were liquid. The admixture was held at 220° F. and stirring continued until the blend was uniform, and then the heating was terminated and 9.9 parts by weight of a derivative of castor oil was added with stirring until again a uniform blend was attained. The resultant blend was allowed to cool to ambient room temperature. The hydrogenated triglyceride had an iodine value of about 5.0, and acid number of about 10.0 maximum, a saponification number of from 193 minimum to 205 maximum, a melting point of 52.0° C. (125.6° F.) and a carbon chain composition of about as follows: 2 percent $C_{14}$; 0.5 percent $C_{15}$; 30 percent $C_{16}$; 2.5 percent $C_{17}$; and 65 percent $C_{18}$. The ethylene copolymer with acrylic acid was one having an acid number (mg KOH/g) of from 112 to 130, a hardness (ddm at 25° C.) of 15 maximum, a molecular weight greater than 2,000, a melting point of 92° C. (198° F.), and a Brookfield viscosity of 650 cps at 140° C. (284° F.). The castor oil derivative was a partially esterified castor oil ester with an acid number of about 50, formed by partial esterification with organic diacid of molecular weight of about 352, commercially available from Westvaco under the trade designation "5150".

EXAMPLE 2

The lubricant prepared as described in Example 1 above was coated onto a metal panel as follows. The lubricant was heated above its melting point of about 61.5° C. (143° F.) to liquify same and the panel to be coated was heated to 145° F. on a standard hot plate. The liquified lubricant was then brushed onto the hot panel until the thickness desired was reached as determined by the weight differential between the panel before and after application of such coating. The coated panel was then allowed to cool to ambient room temperature.

This method of applying the lubricant to a metal panel is suitable for small applications, such as would be practical for laboratory purposes. For commercial uses, the lubricant may be applied to the metal electrostatically, or alternatively the metal may be dipped through a bath of liquified lubricant and the excess lubricant, if any, taken up may be removed with a squeegy or similar device.

Regardless of the coating method chosen, the lubricant according to the present invention has been found to adhere to surface of metals and to level well thereon, providing a uniform coating film.

EXAMPLE 3

The lubricant prepared as described in Example 1 above was tested to determine its drawing characteristics using the Tinius Olsen Cup Tester method Test blanks (discs) were punched from cold rolled steel using an 80 mm die and the discs were then deburred by sanding A 0.54 mil thick film of the lubricant was applied to the discs using the method described in Example 2 above. Using a Tinius Olsen Ductomatic BP-612N Tester the discs were drawn until failure; the hold down force used was 700 lbs. and the ram speed was 0.5 inches per minute. The draws using the lubricant consistently provided cup heights of 1.2 inches with a single draw. In comparison, use of a commercial oil-based prelube comprised of hydrocarbon oil, waxes, sulfonates, lubricity agent and an extreme pressure lubricant, under the same conditions resulted in a cup of only 0.800 inches of height

EXAMPLE 4

The lubricant prepared as described in Example 1 above was tested to determine whether it would provide suitable corrosion protection to metal during storage or shipping in high humidity atmospheres. The test is an accelerated one, wherein the adverse environmental conditions are increased and the time factor reduced for practical purposes. Standard "Q" panels (4" by 8") (cold rolled steel) were cleaned by washing in Freon TF and then air dried. The lubricant was applied as described in Example 2 above to one side of the panel to provide a coating film that is 0.54 mil thick, and then hung vertically for three hours before exposure to the test atmosphere. The test atmosphere was a condensing humidity atmosphere of water vapor, generated by heating deionized water, which condensed on the coated sides of the panels causing a washing action. The panels were examined visually, without disturbing the arrangement, at 24 hour intervals. The test was terminated after 21 days, no rust having formed on the panels coated with the lubricant according to the present invention. In comparison, panels so tested that were coated with liquid commercial prelubes or rust prevention aids began to corrode after 5 to 7 days of exposure to the condensing atmosphere. Hence this test demonstrates that the lubricant according to the present invention provides excellent corrosion protection under high humidity conditions.

EXAMPLE 5

The lubricant prepared as described in Example 1 above was tested to determine whether it would provide corrosion protection in high salt content atmospheres such as might be encountered when storing or shipping the metal near the sea. The coating, processing, and evaluation procedures are similar to those described in Example 4 above except that the panels are placed in a test chamber having an atmosphere that was 5 percent salt fog, generated using ASTM test method B117 salt fog apparatus and the temperature within the test chamber was held at 95° F. The panels were examined visually, without disturbance to the test chamber, at 24 hour periods, and terminated at 48 hours from initial placement in the test chamber. At 24 hours, the panels contained 10 percent rust, and at 48 hours, 60 percent rust. In comparison to commercial rust prevention aids (100% rust in 48 hours) and oil based prelubes (70% rust in 48 hours), the lubricant is thus shown to provide a better than conventional level of corrosion protection in this test (Panels with no coating will become 100% rusted after about 8 hours under these test conditions.)

EXAMPLE 6

The lubricant prepared as described in Example 1 above was tested for compatibility with electrocoated paint primers as follows. The panels used for this test are cold rolled steel panels supplied from Advanced Coating Technology Company of Detroit, Mich., and are received cleaned and phosphated as they would be used commercially. The panels are used as supplied. The bottom half of such type of panels, measuring 4 by 12 inches, were coated up to one-half inch from the edge with the lubricant using the method described in Example 2 above, at coating weights ranging from 100 to 2,000 mg/sq. ft. based on the area of the panel being coated. Over such coated areas were placed the same type of panels measuring 4 by 6 inches, and the sets were secured together with clips. The sets were first coated with a commercial electrostatic primer at 83° F. and 250 volts for the time required to obtain a primer coating thickness of 1.25 mils. The sets were then baked at 360° F. for twenty-minutes, followed by a visual examination for craters. In this test a lubricant, although sandwiched between panels, may vaporize during oven baking and condense on the paint surface, causing craters, such as might occur during baking of automotive body parts having deep bends in which a prelube may be trapped until vaporized on heating. The craters that may form under such conditions are discontinuities in the paint film. The commercially acceptable number of craters for a panel set in this test is twenty-five for a lubricant coating weight of 250 to 300 mg/sq. ft. Above this maximum a lubricant is deemed incompatible with the electrostatic primer. The lubricant according to the present invention was determined compatible with the electrostatic primer by this test at coating levels up to 750 mg/sq. ft., which is more than double the normal commercial standard.

EXAMPLE 7

Standard "Q" panels measuring 3 by 6 inches were prepared and coated as described in Example 4 above using the lubricant prepared as described in Example 1 above, and were then stacked together, one on top of the other, to form a pack fastened together at the corners with "C" clamps. The stack was then placed in an oven held at the constant temperature of 100° F. At seven day intervals the stack was opened, each panel examined visually for staining, and then the stack was rebuilt and returned to the oven. This test was continued for four weeks during which time no staining was detected on any of the panels. Hence the lubricant according to the present invention should not cause staining to steel even upon long storage periods at ambient temperatures normally encountered.

EXAMPLE 8

The lubricant prepared as described in Example 1 above was tested to determine whether it was removed from a metal surface on which it had been coated after cleaning under commercially acceptable conditions with an alkaline cleaner. Three standard "Q" panels were coated with the lubricant by the method described in Example 2 above. The lubricant was applied to one side at 500 milligrams per square foot of panel area. A gallon of cleaning solution was prepared using one ounce of powdered alkaline cleaner(used commercially in the automotive field) per gallon of water. The cleaning solution was then heated to 145° F. with stirring, the stirring being terminated upon stabilization of the temperature at 145° F. One of the coated panels was immersed in this cleaning solution for 15 seconds per side. The rinsed panel was then evaluated visually for clealiness based on a water breakfree surface. In this test, if after a given time of immersion in the cleaning solution the panel being tested was found less than 100 percent clean, the test was repeated with a fresh coated panel and a fresh cleaning solution but with an immersion time in the cleaning solution increased. Such repetitions with increasing immersion times are continued until a panel is 100 percent cleaned by a given immersion. The coated panels here were determined to be 90 percent cleaned of the lubricant by an immersion time of 30 seconds, and 100 percent cleaned by an immersion of 60 seconds. This test was repeated twice with commensurate results, which are within commercially acceptable standards for the automotive industry. In comparison, commercial rust prevention agents require 15 to 30 seconds for 100 percent cleansing and commercial oil based prelubes require 120 to 400 seconds for 100 percent cleansing.

EXAMPLE 9

The lubricant prepared as described in Example 1 above was tested for compatibility with adhesives of the type used in automotive applications as follows. Strips of cold rolled steel, 1 by 6 inch panels, were cleaned, rinsed and dried. Using the method described in Example 2 above, the lubricant was coated onto several panels at three different thicknesses or coating weights, i.e., 300, 500, and 1,000 milligrams per square foot of panel. For each coating thickness here, two panels were prepared. To each of the six panels with a lubricant coating and an equal number of unlubricated panels a one-half inch wide strip of adhesive was appled and then wire spacers, of 0.005 inch diameter, were placed in the adhesive. The adhesive used was one in common commercial use in the automotive industry for providing adhesive seals between structural components. To the adhesive side of each such panel was clamped a second clean panel having no lubricant coating, and this clamping forces out the adhesive in excess of that in the space between panels as determined by the diameter of the spacer wires. Hence the panel sets are provided in an adhesive coating of uniform and known thickness. The panel sets were then baked at 340° F. for one hour and allowed to recover at ambient room temperature for twenty-four hours. Using an Instrom Universal Tester, the panels of the sets were pulled until failure of the adhesive bond between them, noting the amount of force required to break the bond and whether the break was "cohesive". By "cohesive" is meant here that when the bond fails and the panels break apart there remains adhesive on both panels of the set; if the adhesive does not adhere to one of the two panels of a set, regardless of whether a reasonably high level of force was required to break the bond, the lubricant being tested is deemed to have failed this test. A second group of panel sets, prepared as described heretofore is this Example, was subjected to a water immersion bath at 130° F. before the failure testing; testing of each such panel set was conducted immediately after removal from the immersion bath. For panel sets tested without the water immersion bath treatment, failure of the adhesive bond at 1000 PSI of pressure or less is considered commercially unacceptable. For panel sets tested after the water immersion bath treatment, failure of the adhesive bond at 500 PSI pressure or less is considered commercially unacceptable. The lubricated panels here, at each lubricant thickness, and with and without the water immersion bath treatment, were each well above the commercially acceptable minimum. The test results are set forth below in Table 1. The breaks were found to be cohesive in all instances.

TABLE 1

| Lubricant Coating Weight ($mg/ft^2$) | Water Immersion Both Treatment | Bond Failure Pressure (PSI) |
|---|---|---|
| None | without | 2,175 |
| None | without | 2,200 |
| None | without | 1,925 |
| 300 | without | 2,175 |
| 500 | without | 2,050 |
| 1,000 | without | 2,225 |
| None | with | 1,950 |
| None | with | 1,850 |
| None | with | 2,100 |
| 300 | with | 1,700 |
| 500 | with | 1,800 |
| 1,000 | with | 1,450 |

COMMERCIAL APPLICABILITY OF THE INVENTION

The lubricant and method of the present invention are useful in the metalworking industries, particularly those industrial applications where a prelube is desired.

I claim:

1. A lubricant for metalworking operations comprising:

at least one substantially saturated ester formed of a polyhydric alcohol and at least one carboxylic acid;

an effective plasticizing amount, comprising from 5 15 weight percent, of a partially-esterified vegetable oil formed with an organic diacid having a a molecular weight of from 250 to 500, an air-oxidized vegetable oil, a high molecular weight alkali metal sulfonate salt, a high carbon amide without N-substitution, a high molecular weight ethoxylated organic alcohol formed by ethoxylation of primary alcohol, or mixtures thereof; and from 0.5 to 3.0 weight percent of an ethylene homopolymer, a polymer derived from ethylene and ethylenically unsaturated carboxylic acid monomers, oxidized derivatives of ethylene polymer, or mixtures thereof, said polymers having a molecular weight in excess of 2,000.

2. The lubricant of claim 1 further including from 0.5 to 3.0 weight percent of an antioxidant.

3. The lubricant of claim 2 wherein said antioxidant is a hindered phenol.

4. The lubricant of claim 1 wherein said substantially saturated ester is formed of aliphatic polyhydric alcohol having from 2 to 10 carbon atoms.

5. The lubricant of claim 4 wherein said substantially saturated ester is formed of aliphatic monocarboxylic acids having from 2 to 26 carbon atoms.

6. The lubricant of claim 5 wherein said aliphatic monocarboxylic acids have substantially unbranched carbon chains.

7. The lubricant of claim 6 wherein said substantially saturated ester has a melting point of from 30° to 100° C.

8. The lubricant of claim 7 wherein said substantially saturated ester is a diglyceride or triglyceride formed with carboxylic acids at least 90 percent of which have carbon chains containing from 14 to 22 carbon atoms.

9. The lubricant of claim 8 wherein said substantially saturated ester is substantially hydrogenated triglyceride derived from tallow.

10. The lubricant of claim 1 wherein said partially-esterified vegetable oil is a castor oil partial ester having an acid number of 50.

11. The lubricant of claim 1 wherein said air-oxidized vegetable oil is an air-oxidized soybean oil.

12. The lubricant of claim 1 wherein said high molecular weight alkali metal sulfonate has a molecular weight of from 400 to 1,000.

13. The lubricant of claim 1 wherein said high carbon amide has a carbon chain comprised of from 10 to 22 carbon atoms.

14. The lubricant of claim 13 wherein said high carbon amide is oleyl amide.

15. The lubricant of claim 1 wherein said high molecular weight ethoxylated organic alcohol is formed of a 10 to 20 carbon alcohol and from 2 to 8 ethylene oxide moles per mole of alcohol.

16. The lubricant of claim 15 wherein said high molecular weight ethoxylated organic alcohol is formed of a 14 to 16 carbon primary alcohol and about 4 ethylene oxide moles per mole of primary alcohol.

17. The lubricant of claim 1 wherein said ethylene homopolymer, polymer derived from ethylene and ethylenically unsaturated carboxylic acid monomers, oxidized derivatives thereof, or mixtures thereof, is a composition having a melting point of from 85° to 115° C.

18. The lubricant of claim 1 wherein said ethylene homopolymer, polymer derived from ethylene and ethylenically unsaturated carboxylic acid monomers, oxidized derivatives thereof, or mixtures thereof, is a composition having a hardness of from 9 to 22 dmm at 25° C.

19. The lubricant of claim 1 wherein said ethylene homopolymer, polymer derived from ethylene and ethylenically unsaturated carboxylic acid monomers, oxidized derivatives thereof, or mixtures thereof, is a composition having an acid number of from 70 to 140.

20. The lubricant of claim 1 wherein said polymer derived from ethylene and ethylenically unsaturated carboxylic acid monomers is a copolymer of ethylene and acrylic acid having a hardness of from 12 to 16 and an acid number of from 110 to 130.

21. The lubricant of claim 1 having from 80 to 95 weight percent of at least one substantially saturated ester formed of an aliphatic polyhydric alcohol having from 2 to 10 carbons atoms and aliphatic monocarboxylic acids having from 2 to 26 carbons atoms.

22. A method of lubricating metal comprising: applying to metal a coating of the lubricant of claim 1 in molten form.

23. The method of claim 22 wherein said lubricant is applied to said metal and then said metal is worked without removal of said lubricant.

24. The method of claim 23 wherein said lubricant is as defined in claim 2.

25. The method of claim 23 wherein said lubricant is as defined in claim 4.

26. The method of claim 25 wherein said lubricant is as defined in claim 8.

27. The method of claim 23 wherein said lubricant is as defined in claim 11.

28. The method of claim 23 wherein said lubricant is as defined in claim 12.

29. The method of claim 23 wherein said lubricant is as defined in claim 13.

30. The method of claim 23 wherein said lubricant is as defined in claim 15.

31. The method of claim 23 wherein said lubricant is as defined in claim 17.

32. The method of claim 23 wherein said lubricant is as defined in claim 18.

33. The method of claim 23 wherein said lubricant is as defined in claim 19.

34. The method of claim 23 wherein said lubricant is as defined in claim 20.

* * * * *